US009437907B2

(12) United States Patent
Sakasai et al.

(10) Patent No.: US 9,437,907 B2
(45) Date of Patent: Sep. 6, 2016

(54) PHASE SHIFT CIRCUIT AND ANTENNA DEVICE COMPRISED OF AT LEAST ONE MOVABLE DIELECTRIC BODY OVERLAPPING WITH AN INTERSECTING PART OF A CONDUCTOR

(71) Applicant: HITACHI METALS, LTD., Tokyo (JP)

(72) Inventors: Kazuhiro Sakasai, Hitachi (JP); Tomoyuki Ogawa, Hitachi (JP)

(73) Assignee: Hitachi Metals, Ltd., Tokyo (JP)

( * ) Notice: Subject to any disclaimer, the term of this patent is extended or adjusted under 35 U.S.C. 154(b) by 37 days.

(21) Appl. No.: 14/081,268

(22) Filed: Nov. 15, 2013

(65) Prior Publication Data

US 2014/0232484 A1 Aug. 21, 2014

(30) Foreign Application Priority Data

Feb. 15, 2013 (JP) ..... 2013-28406

(51) Int. Cl.
*H01P 1/18* (2006.01)
*H01P 9/00* (2006.01)

(52) U.S. Cl.
CPC ..... *H01P 1/184* (2013.01); *H01P 9/00* (2013.01); *H01P 9/006* (2013.01)

(58) Field of Classification Search
CPC ..... H01P 1/18; H01P 1/184; H01P 9/00; H01P 9/006
USPC ..... 333/161
See application file for complete search history.

(56) References Cited

U.S. PATENT DOCUMENTS

| | | | | |
|---|---|---|---|---|
| 3,440,573 | A * | 4/1969 | Butler | 333/161 |
| 5,940,030 | A | 8/1999 | Hampel et al. | |
| 6,333,683 | B1 * | 12/2001 | Hampel | 333/161 |
| 2010/0073105 | A1 * | 3/2010 | Chang et al. | 333/161 |

FOREIGN PATENT DOCUMENTS

| | | | |
|---|---|---|---|
| JP | 11-205002 | A | 7/1999 |
| JP | 2001-203501 | A | 7/2001 |
| JP | 2002-158502 | A | 5/2002 |
| JP | 4745213 | B2 | 8/2011 |

OTHER PUBLICATIONS

Japanese Office Action issued in counterpart Japanese Application No. 2013-0028406 dated Apr. 26, 2016, with English translation (five (5) pages).

* cited by examiner

*Primary Examiner* — Benny Lee
(74) *Attorney, Agent, or Firm* — Crowell & Moring LLP

(57) ABSTRACT

Techniques capable of reducing the width-direction size of a phase shift circuit as much as possible are provided. A phase shift circuit has a signal line, a first dielectric plate, and a second dielectric plate. The signal line has first to third intersecting parts extending in a direction intersecting with a longitudinal direction of the phase shift circuit. On the other hand, the first dielectric plate and the second dielectric plate have first to third overlapping parts overlapping the intersecting parts of the signal line. When the first dielectric plate and the second dielectric plate are moved in the longitudinal direction of the phase shift circuit, the overlapped areas between the intersecting parts of the signal line and the overlapping parts of the first dielectric plate and the second dielectric plate are changed.

10 Claims, 7 Drawing Sheets

PHASE SHIFT CIRCUIT AND ANTENNA DEVICE COMPRISED OF AT LEAST ONE MOVABLE DIELECTRIC BODY OVERLAPPING WITH AN INTERSECTING PART OF A CONDUCTOR

CROSS-REFERENCE TO RELATED APPLICATION

The present application claims priority from Japanese Patent Application No. 2013-28406 filed on Feb. 15, 2013, the content of which is hereby incorporated by reference into this application.

TECHNICAL FIELD OF THE INVENTION

The present invention relates to a phase shift circuit suitable for an antenna device.

BACKGROUND OF THE INVENTION

Conventional phase shift circuits used in a base-station antenna are described in Japanese Patent No. 4745213 (Patent Document 1) and U.S. Pat. No. 5,940,030 (Patent Document 2).

A phase shift circuit described in Patent Document 1 includes a signal line, a ground conductor provided to be opposed to the signal line, and a dielectric plate inserted between the signal line and the ground conductor from a direction perpendicular to a longitudinal direction of the signal line. In the phase shift circuit described in Patent Document 1, the overlapped area between the dielectric plate and the signal line is changed depending on the inserted length of the dielectric plate, and thereby controls the phase of the signal output from the signal line.

Patent Document 2 describes a phase shift circuit having substantially the same configuration as the phase shift circuit described in Patent Document 1. Nevertheless, the phase shift circuit described in Patent Document 2 has a characteristic impedance of a signal line changed by inserting a dielectric plate. That is, a circuit to match impedance is also incorporated to the phase shift circuit described in Patent Document 2.

SUMMARY OF THE INVENTION

In the phase shift circuits described in Patent Documents 1 and 2 mentioned above, the dielectric plate is inserted from the direction perpendicular to the longitudinal direction of the signal line. Therefore, the size of the phase shift circuit in the direction perpendicular to the longitudinal direction of the signal line, that is, in the width direction is increased, with the result that the width-direction size of a base-station antenna also tends to be increased.

When the width-direction size of the base-station antenna is increased, the following problems arise. For example, the wind-pressure load received by the base-station antenna is increased. Moreover, since the size of an iron tower on which the base-station antenna is installed is also increased, an installation site for the iron tower is expanded.

An object of the present invention is to reduce the width-direction size of a phase shift circuit.

The present invention has been made for achieving the object mentioned above, and according to an embodiment of the present invention, a phase shift circuit for changing a phase of a signal includes: a first dielectric body and a second dielectric body opposed to each other; and a first conductor disposed between the first dielectric body and the second dielectric body. The first conductor is provided with an intersecting part extending in a direction intersecting with a longitudinal direction of the phase shift circuit. Each of the first dielectric body and the second dielectric body is provided with an overlapping part overlapping the intersecting part of the first conductor. Also, an overlapped area between the intersecting part and the overlapping part is changed as the first dielectric body and the second dielectric body are moved in the longitudinal direction of the phase shift circuit.

The present invention is capable of reducing the width-direction size of a phase shift circuit.

BRIEF DESCRIPTIONS OF THE DRAWINGS

DETAILED DESCRIPTION OF THE PREFERRED EMBODIMENTS

Figure 1:
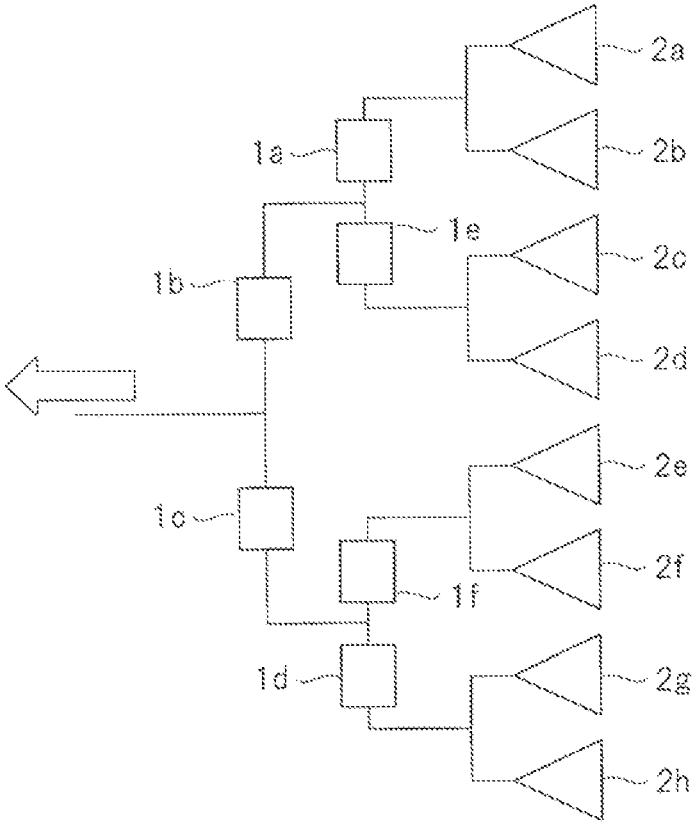
FIG. 1 is a schematic drawing showing an example of the configuration of a base-station antenna according to an embodiment of the present invention.

In the embodiments described below, the invention will be described in a plurality of sections or embodiments when required as a matter of convenience. However, these sections or embodiments are not irrelevant to each other unless otherwise stated. Also, in the embodiments described below, when referring to the number of elements (including number of pieces, values, amount, range, and the like), the number of the elements is not limited to a specific number unless otherwise stated or except the case where the number is apparently limited to a specific number in principle, and the number larger or smaller than the specified number is also applicable.

Further, in the embodiments described below, it goes without saying that the components (including element steps) are not always indispensable unless otherwise stated or except for the case where the components are apparently indispensable in principle. Similarly, in the embodiments described below, when the shape of the components, positional relation thereof, and the like are mentioned, the substantially approximate and similar shapes and the like are included therein unless otherwise stated or except for the case where it is conceivable that they are apparently excluded in principle. The same goes for the numerical value and the range described above.

[Outline of Embodiment]

First, an outline of an embodiment will be described. In the description of the outline of the present embodiment, constituent elements of the embodiment are denoted by corresponding reference numerals.

Figure 2:
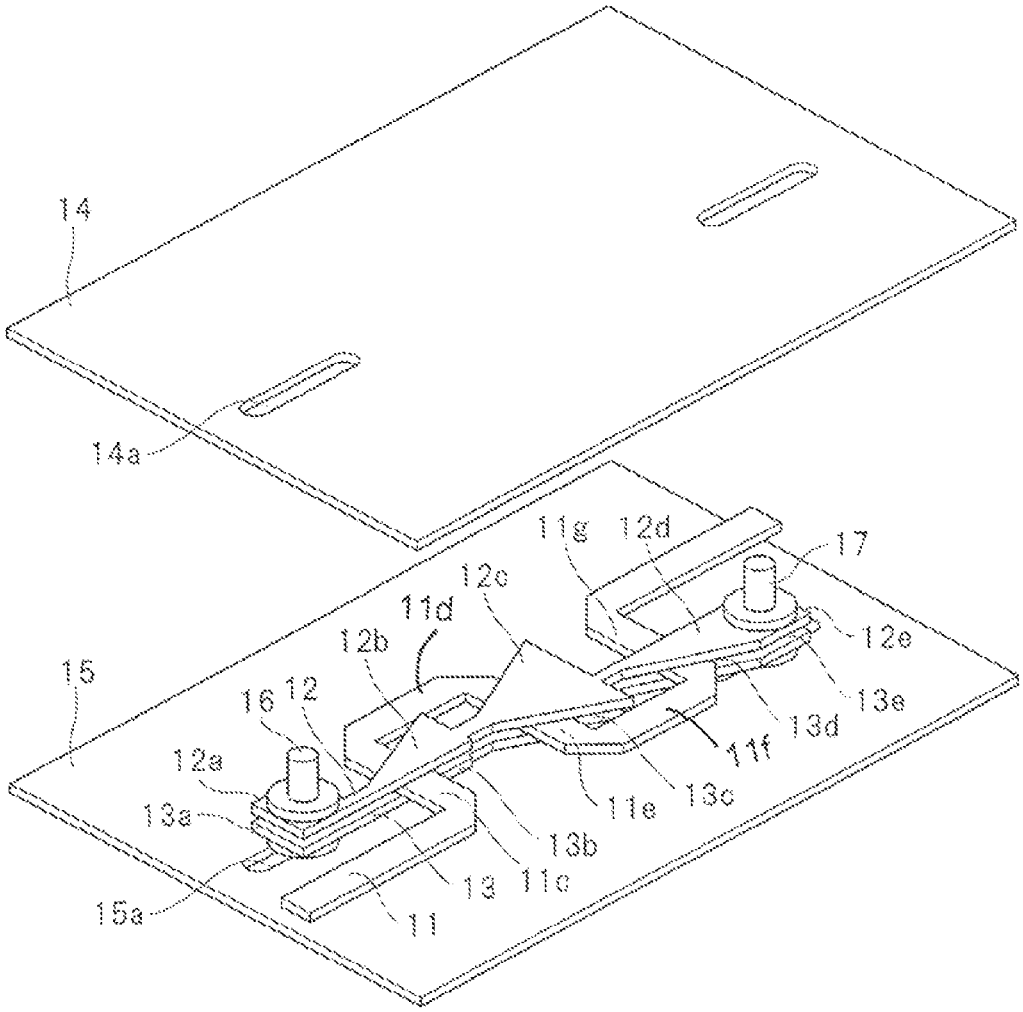
FIG. 2 is a perspective view showing an example of the structure of a phase shift circuit applied to the base-station antenna of FIG. 1.

A phase shift circuit according to the present embodiment changes the phase of an input signal. As illustrated in FIG. 2, for example, the phase shift circuit according to the present embodiment has a signal line 11 serving as a first conductor and a first dielectric plate 12 and a second dielectric plate 13 serving as a first dielectric body and a second dielectric body, respectively. The first dielectric plate 12 and the second dielectric plate 13 are opposed to each other, and the signal line 11 is disposed between the first dielectric plate 12 and the second dielectric plate 13. In this case, the signal line 11 of the present embodiment has a rectangular cross section. Thus, the signal line 11 has two principal surfaces. Therefore, one of the first dielectric plate 12 and the second dielectric plate 13 opposed to each other with the signal line 11 interposed therebetween is opposed to one of the principal surfaces of the signal line 11, and the other of the first dielectric plate 12 and the second dielectric plate 13 is opposed to the other principal surface of the signal line 11. Therefore, in the following description, of the two principal surfaces of the signal line 11, the principal surface opposed to the first dielectric plate 12 is referred to as "first principal surface", and the principal surface opposed to the second dielectric plate 13 is referred to as "second principal surface". In other words, the dielectric plate opposed to the first principal surface of the signal line 11 is the first dielectric plate 12, and the dielectric plate opposed to the second principal surface of the signal line 11 is the second dielectric plate 13.

Furthermore, the signal line 11 includes a plurality of intersecting parts (first to third intersecting parts 11*c*, 11*e*, and 11*g*) extending in the direction intersecting with the longitudinal direction of the phase shift circuit. On the other hand, the first dielectric plate 12 and the second dielectric plate 13 have a plurality of overlapping parts (first to third overlapping parts 12*b*, 13*b*, 12*c*, 13*c*, 12*d*, and 13*d*) overlapping the intersecting parts of the signal line 11. When the first dielectric plate 12 and the second dielectric plate 13 are moved in the longitudinal direction of the phase shift circuit, the overlapped areas between the intersecting parts 11*c*, 11*e*, and 11*g* of the signal line 11 and the overlapping parts 12*b*, 13*b*, 12*c*, 13*c*, 12*d*, and 13*d* of the first dielectric plate 12 and the second dielectric plate 13 are changed.

The phase shift circuit according to the present embodiment is a phase shift circuit suitable for application to a base-station antenna as an example of an antenna device.

Hereinafter, embodiments of the present invention will be described in detail with reference to the accompanying drawings. Note that components having the same function are denoted by the same reference numerals throughout the drawings for describing the embodiments, and the repetitive description thereof will be omitted.

Embodiment

An embodiment will be described with reference to FIG. 1 to FIG. 8. In the description of the present embodiment, abase-station antenna and a phase shift circuit applied to the base-station antenna are taken as an example.

<Configuration of Base-Station Antenna>

First, a configuration of the base-station antenna according to the present embodiment will be described with reference to FIG. 1. FIG. 1 is a schematic drawing showing an example of the configuration of the base-station antenna.

As shown in FIG. 1, the base-station antenna has an input terminal (not shown) to which a high-frequency signal output from a high-frequency circuit (not shown) or the like is input, a plurality of phase shift circuits 1*a*, 1*b*, 1*c*, 1*d*, 1*e* and 1*f* (collectively referred to also as "phase shift circuits 1"), and a plurality of antenna elements 2*a*, 2*b*, 2*c*, 2*d*, 2*e*, 2*f*, 2*g* and 2*h* (collectively referred to also as "antenna elements 2"). FIG. 1 shows six phase shift circuits 1 and eight antenna elements 2 as an example, but the numbers of the phase shift circuits 1 and the antenna elements 2 are not limited to those illustrated in FIG. 1.

To the input terminal of the base-station antenna shown in FIG. 1, input sides of the second phase shift circuit 1*b* and the third phase shift circuit 1*c* are connected. In other words, the second phase shift circuit 1*b* and the third phase shift circuit 1*c* are connected in parallel with each other to the input terminal. Furthermore, to an output side of the second phase shift circuit 1*b*, input sides of the first phase shift circuit la and the fifth phase shift circuit 1*e* are connected in parallel with each other. Also, to an output side of the third phase shift circuit 1*c*, input sides of the fourth phase shift circuit 1*d* and the sixth phase shift circuit 1*f* are connected in parallel with each other. To an output side of the first phase shift circuit 1*a*, the first antenna element 2*a* and the second antenna element 2*b* are connected in parallel with each other. To an output side of the fifth phase shift circuit 1*e*, the third antenna element 2*c* and the fourth antenna element 2*d* are connected in parallel with each other. To an output side of the sixth phase shift circuit 1*f*, the fifth antenna element 2*e* and the sixth antenna element 2*f* are connected in parallel with each other. To an output side of the fourth phase shift circuit 1*d*, the seventh antenna element 2*g* and the eighth antenna element 2*h* are connected in parallel with each other.

The phase shift circuits 1 and the antenna elements 2 as described above are mounted inside an antenna main body having a cylindrical shape. In this case, the eight antenna elements 2 are arranged along the longitudinal direction of the antenna main body having the cylindrical shape, and the corresponding phase shift circuits 1 are connected to the arranged antenna elements 2. Then, each of the phase shift circuits 1 changes the phase of the input high-frequency signal and outputs the high-frequency signal whose phase has been changed to the corresponding antenna elements 2. Thus, the base-station antenna having predetermined directivity is realized.

For example, the first, second, and fifth phase shift circuits 1*a*, 1*b*, and 1*e* connected to the first to fourth antenna elements 2*a* to 2*d* disposed on an upper side of the antenna main body having the cylindrical shape advance the phase of the input high-frequency signal and output the high-frequency signal whose phase has been advanced to the first to fourth antenna elements 2*a* to 2*d*. On the other hand, the third, fourth, and sixth phase shift circuits 1*c*, 1*d*, and 1*f* connected to the fifth to eighth antenna elements 2*e* to 2*h* disposed on a lower side of the antenna main body retard the phase of the input high-frequency signal and output the high-frequency signal whose phase has been retarded to the fifth to eighth antenna elements 2*e* to 2*h*. As a result, a desired beam tilt angle (directivity) can be realized. Generally, since the base-station antenna is installed at a high location and mobile phones and other communication devices are located below the base-station and are communication targets thereof, the base-station antenna has a characteristic of tilting a beam downward relative to a horizontal plane.

<Structure of Phase Shift Circuit>

Figure 3:
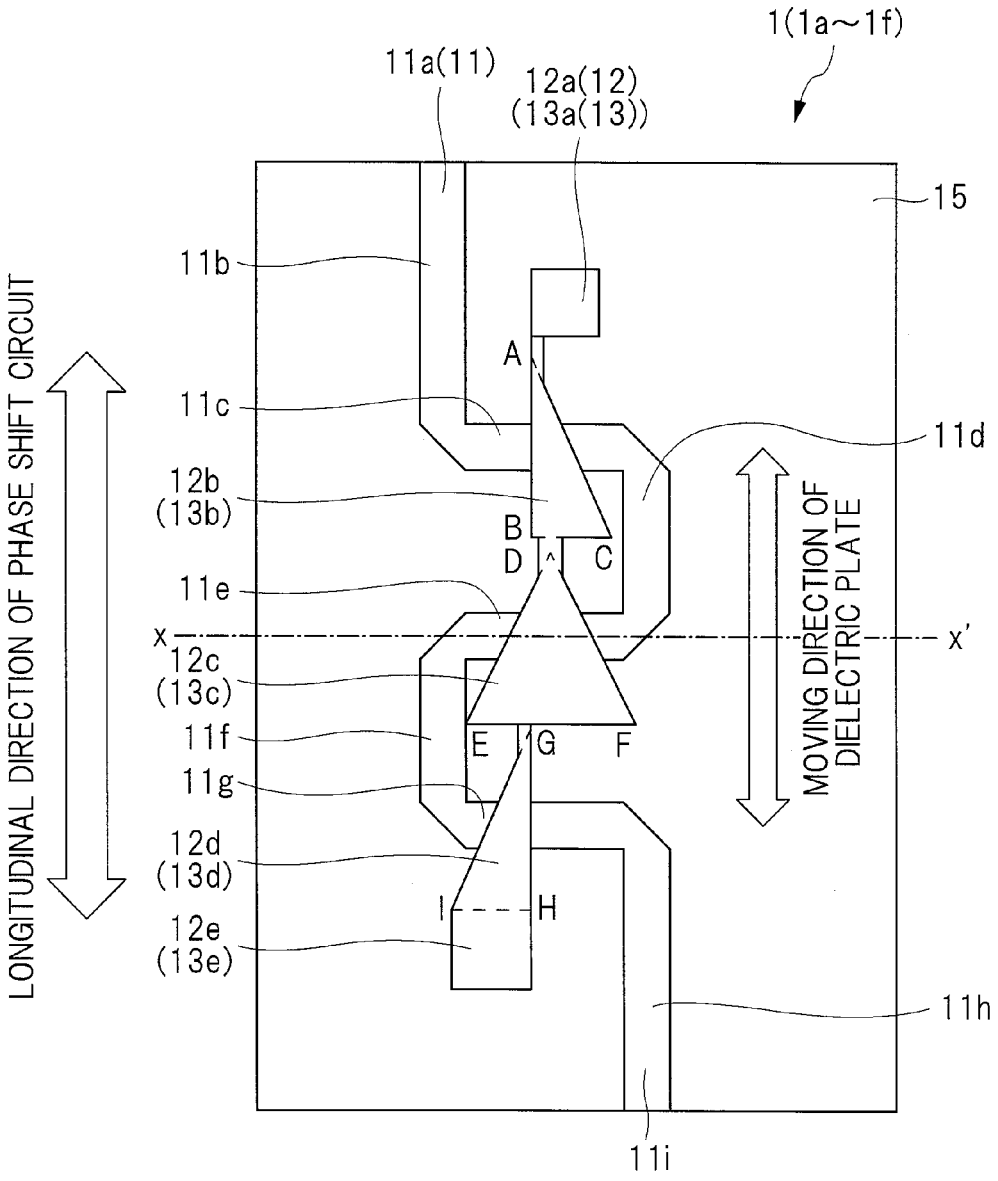
FIG. 3 is a plan view showing an example of the structure of the phase shift circuit applied to the base-station antenna of FIG. 1.
Figure 4:
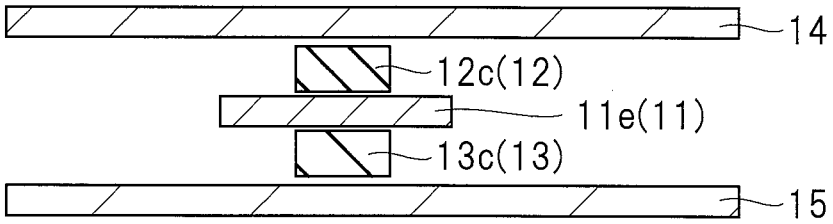
FIG. 4 is a cross-sectional view taken along an x-x' section line of FIG. 3.

Next, the structure of the phase shift circuit 1 (1*a* to 1*f*) shown in FIG. 1 will be described with reference to FIG. 2 to FIG. 4. FIG. 2 is a perspective view showing an example of the structure of the phase shift circuit 1. FIG. 3 is a plan view showing an example of the structure of the phase shift circuit 1. FIG. 4 is a cross-sectional view taken along the x-x' section line of FIG. 3.

The phase shift circuit 1 according to the present embodiment is a phase shift circuit capable of changing the phase of an input signal and then outputting the signal. As shown mainly in FIG. 2, the phase shift circuit 1 has a signal line 11, a first dielectric plate 12, a second dielectric plate 13, a first ground plate 14, and a second ground plate 15. The first dielectric plate 12 is disposed to be opposed to a first principal surface of the signal line 11, and the second dielectric plate 13 is disposed to be opposed to a second principal surface of the signal line 11. In the following descriptions, sometimes, the first principal surface of the signal line 11 is referred to as "front surface", and the second principal surface is referred to as "back surface" to distinguish them from each other. As a matter of course, the distinction is merely distinction for the sake of convenience of description. The first dielectric plate 12 and the second dielectric plate 13 are integrally movable in a longitudinal direction of the phase shift circuit 1. The first ground plate 14 is disposed on the opposite side of the signal line 11 with the first dielectric plate 12 interposed therebetween, and the second ground plate 15 is disposed on the opposite side of the signal line 11 with the second dielectric plate 13 interposed therebetween. In other words, the signal line 11, the first dielectric plate 12, and the second dielectric plate 13 are disposed between the first ground plate 14 and the second ground plate 15 opposed to each other. FIG. 2 shows a state in which the first ground plate 14 on the upper surface side has been removed. Also, although the second dielectric plate 13 is hidden behind the first dielectric plate 12 and invisible in FIG. 3, the reference numerals of constituent elements of the second dielectric plate 13 are also noted and shown in parentheses.

As shown mainly in FIG. 3, the signal line 11 has a signal input end 11*a* disposed on one longitudinal end side of the phase shift circuit 1, a signal output end 11*i* disposed on the other longitudinal end side of the phase shift circuit 1, and a line connecting the signal input end 11*a* and the signal output end 11*i* to each other. On this line, a plurality of intersecting parts extending in the direction intersecting with the longitudinal direction of the phase shift circuit 1 (for example, the perpendicular direction in the present embodiment) and a plurality of connecting parts extending in the direction parallel to the longitudinal direction of the phase shift circuit 1 are provided. In other words, the line is made up of the plurality of intersecting parts and the connecting parts which mutually connect the intersecting parts. As shown in FIG. 3, the signal line 11 in the present embodiment includes a first intersecting part 11*c*, a second intersecting part 11*e*, a third intersecting part 11*g*, a first connecting part 11*b*, a second connecting part 11*d*, a third connecting part 11*f*, and a fourth connecting part 11*h*.

One end of the first intersecting part 11*c* is connected to the signal input end 11*a* through the first connecting part 11*b*. The other end of the first intersecting part 11*c* is connected to one end of the second intersecting part 11*e* through the second connecting part 11*d*. The other end of the second intersecting part 11*e* is connected to one end of the third intersecting part 11*g* through the third connecting part 11*f*. The other end of the third intersecting part 11*g* is connected to the signal output end 11*i* through the fourth connecting part 11*h*.

In other words, the first connecting part 11*b* and the first intersecting part 11*c* are connected in an L-shape in the planar view. The first intersecting part 11*c*, the second connecting part 11*d*, and the second intersecting part 11*e* are connected in a U-shape in the planar view. The second intersecting part 11*e*, the third connecting part 11*f*, and the third intersecting part 11*g* are connected in a U-shape in the planar view. The third intersecting part 11*g* and the fourth connecting part 11*h* are connected in an L-shape in the planar view.

Note that the L-shape includes the shapes approximately close to an L-shape in addition to an L-shape. Similarly, the U-shape includes the shapes approximately close to a U-shape in addition to a U-shape.

As described above, the signal line 11 has a line structure which is connected from the signal input end 11*a* to the signal output end 11*i* through the first connecting part 11*b*, the first intersecting part 11*c*, the second connecting part 11*d*, the second intersecting part 11*e*, the third connecting part 11*f*, the third intersecting part 11*g*, and the fourth connecting part 11*h*. In other words, the signal line 11 includes a line made up of the first connecting part 11*b*, the first intersecting part 11*c*, the second connecting part 11*d*, the second intersecting part 11*e*, the third connecting part 11*f*, the third intersecting part 11*g*, and the fourth connecting part 11*h*, which are connected in a meander shape, and two U-shaped parts are provided on the line. Outside corners of the connecting parts are chamfered.

The first dielectric plate 12 and the second dielectric plate 13 interpose the signal line 11 from the front surface side and the back surface side. In other words, the first dielectric plate 12 and the second dielectric plate 13 are disposed so as to overlap the intersecting parts of the signal line 11. More specifically, the first dielectric plate 12 is disposed on the front surface side of the signal line 11 so as to be opposed to the signal line 11 and overlap the first to third intersecting parts 11*c*, 11*e*, and 11*g* of the signal line 11. Also, the second dielectric plate 13 is disposed on the back surface side of the signal line 11 so as to be opposed to the signal line 11 and overlap the first to third intersecting parts 11*c*, 11*e*, and 11*g* of the signal line 11. Nevertheless, the signal line 11, the first dielectric plate 12, and the second dielectric plate 13 are not in contact with one another.

The first dielectric plate 12 and the second dielectric plate 13 are movable in the longitudinal direction of the phase shift circuit 1 as denoted by the two headed arrow. In other words, the first dielectric plate 12 and the second dielectric plate 13 are movable in the direction perpendicular to the extending direction of the first to third intersecting parts 11*c*, 11*e*, and 11*g* of the signal line 11. In this case, the first dielectric plate 12 and the second dielectric plate 13 are configured so as to be mutually coupled by first supporting parts 12*a* and 13*a* which are one end parts and second supporting parts 12*e* and 13*e* which are the other end parts and be integrally moved in the same direction. Hereinafter, the second dielectric plate 13 will be also described together with the first dielectric plate 12 mainly with reference to FIG. 3.

The first and second dielectric plates 12 and 13 have first overlapping parts 12*b* and 13*b* overlapping the first intersecting part 11*c*, second overlapping parts 12*c* and 13*c* overlapping the second intersecting part 11*e*, and third overlapping parts 12*d* and 13*d* overlapping the third intersecting part 11*g*. Each of the first to third overlapping parts 12*b*, 13*b*, 12*c*, 13*c*, 12*d*, and 13*d* has, for example, a triangular shape or an approximately triangular shape in the planar view.

More specifically, the planar shape of each of the first overlapping parts 12*b* and 13*b* is a right triangle having vertices A, B, and C. In the following description, the side connecting the vertex A and the vertex C to each other will be referred to as a hypotenuse, the side connecting the vertex A and the vertex B to each other will be referred to as a long adjacent side, and the side connecting the vertex B and the vertex C to each other will be referred to as a short adjacent side. The planar shape of each of the second overlapping parts 12*c* and 13*c* is an isosceles triangle having vertices D, E, and F. In the following description, the side connecting the vertex E and the vertex F to each other will be referred to as abase, the side connecting the vertex D and the vertex E to each other will be referred to as a first leg, and the side connecting the vertex D and the vertex F to each other will be referred to as a second leg. The planar shape of each of the third overlapping parts 12*d* and 13*d* is a right triangle having vertices G, H, and I. In the following description, the side connecting the vertex G and the vertex I to each other will be referred to as a hypotenuse, the side connecting the vertex G and the vertex H to each other will be referred to as a long adjacent side, and the side connecting the vertex H and the vertex I to each other will be referred to as a short adjacent side.

Note that the right triangle includes the shapes approximately close to a right triangle in addition to a right triangle. Similarly, the isosceles triangle includes the shapes approximately close to an isosceles triangle in addition to an isosceles triangle. Also, with respect to the long adjacent side and the short adjacent side of the right triangle, the adjacent side having a longer length and the adjacent side having a shorter length of the two adjacent sides are referred to as the long adjacent side and the short adjacent side, respectively. Similarly, with respect to the first leg and the second leg of the isosceles triangle, one leg of the two legs is referred to as the first leg, and the other leg of the two legs is referred to as the second leg.

Furthermore, the vertices A of the first overlapping parts 12*b* and 13*b* are connected to the first supporting parts 12*a* and 13*a*. The vertices B of the first overlapping parts 12*b* and 13*b* are connected to the vertices D of the second overlapping parts 12*c* and 13*c*. Intermediate parts of the bases connecting the vertices E and the vertices F of the second overlapping parts 12*c* and 13*c* to each other are connected to the vertices G of the third overlapping parts 12*d* and 13*d*. The vertices H of the third overlapping parts 12*d* and 13*d* are connected to the second supporting parts 12*e* and 13*e*. These parts are mutually connected via coupling parts having the shapes which enable mutual coupling. For example, the first supporting parts 12*a* and 13*a* and the second supporting parts 12*e* and 13*e* have square shapes in the planar view.

Then, the first overlapping parts 12*b* and 13*b*, the second overlapping parts 12*c* and 13*c*, and the third overlapping parts 12*d* and 13*d* can be moved in the longitudinal direction of the phase shift circuit 1 by moving the first supporting parts 12*a* and 13*a* and the second supporting parts 12*e* and 13*e* of the first and second dielectric plates 12 and 13 in the longitudinal direction of the phase shift circuit 1.

Also, the first and second dielectric plates 12 and 13 have a following layout with respect to the signal line 11. The long adjacent sides connecting the vertices A and the vertices B of the first overlapping parts 12*b* and 13*b* form a right angle with the extending direction of the first intersecting part 11*c*. The hypotenuses connecting the vertices A and the vertices C of the first overlapping parts 12*b* and 13*b* form 65 degrees, which is a first angle equal to or less than a right angle, with the extending direction of the first intersecting part 11*c*. The second legs connecting the vertices D and the vertices F of the second overlapping parts 12*c* and 13*c* to each other form 65 degrees, which is a second angle equal to or less than a right angle, with the extending direction of the second intersecting part 11*e*. The first legs connecting the vertices D and the vertices E of the second overlapping parts 12*c* and 13*c* to each other form an angle of 65 degrees, which is a third angle equal to or less than a right angle, with the extending direction of the second intersecting part 11*e*. The hypotenuses connecting the vertices G and the vertices I of the third overlapping parts 12*d* and 13*d* to each other form an angle of 65 degrees, which is a fourth angle equal to or less than a right angle, with the extending direction of the third intersecting part 11*g*. The long adjacent sides connecting the vertices G and the vertices H of the third overlapping parts 12*d* and 13*d* to each other form a right angle with the extending direction of the third intersecting part 11*g*.

Note that the right angle includes the angles approximately close to 90 degrees in addition to 90 degrees. Similarly, the angle of 65 degrees include the angles approximately close to 65 degrees in addition to 65 degrees and may be of any angle in so far as it is equal to or less than a right angle in the present embodiment.

Also, in the first and second dielectric plates 12 and 13, the long adjacent sides connecting the vertices A and the vertices B of the first overlapping parts 12*b* and 13*b* to each other and the long adjacent sides connecting the vertices G and the vertices H of the third overlapping parts 12*d* and 13*d* to each other are disposed on the same straight line. Note that the straight line includes the lines approximately close to a straight line in addition to a straight line. The layout of the long adjacent sides connecting the vertices A and the vertices B to each other and the long adjacent sides connecting the vertices G and the vertices H to each other is not limited to the straight line, but may be configured so that the adjacent sides are disposed to be parallel to each other.

As described above, the first and second dielectric plates 12 and 13 have plate-like bodies which are connected from the first supporting parts 12*a* and 13*a* to the second supporting parts 12*e* and 13*e* through the first overlapping parts 12*b* and 13*b*, the second overlapping parts 12*c* and 13*c*, and the third overlapping parts 12*d* and 13*d*.

In the phase shift circuit 1 configured in the above-described manner, when the first and second dielectric plates 12 and 13 are moved in the longitudinal direction of the phase shift circuit 1, the areas (overlapped area) in which the first to third overlapping parts 12*b*, 13*b*, 12*c*, 13*c*, 12*d*, and 13*d* of the first and second dielectric plates 12 and 13 and the first to third intersecting parts 11*c*, 11*e*, and 11*g* of the signal line 11 are mutually overlapped are changed, and the phase of the signal input from the signal input end 11*a* of the signal line 11 is controlled. More specifically, the signal whose phase has been advanced or the signal whose phase has been retarded with respect to the signal input to the signal input end 11*a* of the signal line 11 is output from the signal output end 11*i*.

Figure 5A:
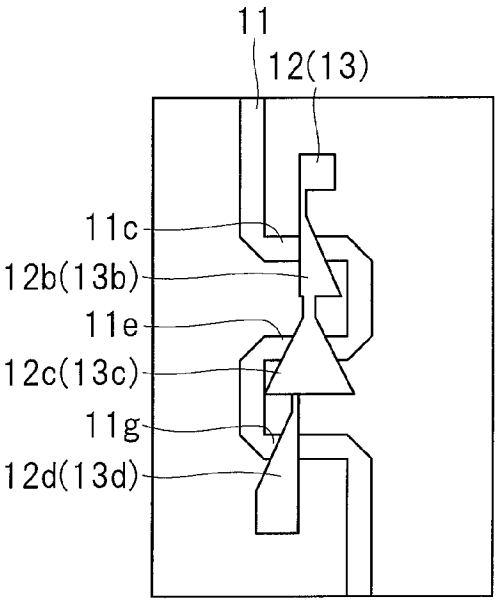
FIG. 5A is an explanatory drawing showing an example of movement of first and second dielectric plates in a simulation using the structure of the phase shift circuit of FIG. 2 to FIG. 4.

The first and second dielectric plates 12 and 13 shown in FIG. 3 are located at an intermediate position of the movable range of the first and second dielectric plates 12 and 13 (shown also in FIG. 5A). In the case of taking the intermediate position as a reference, when the first and second dielectric plates 12 and 13 are moved to a movable range end in the downward direction on the paper surface of FIG. 3, the overlapped areas between the first to third overlapping parts 12*b*, 13*b*, 12*c*, 13*c*, 12*d*, and 13*d* and the first to third intersecting parts 11*c*, 11*e*, and 11*g* are minimized (shown in FIG. 5B). To the contrary, when the first and second dielectric plates 12 and 13 are moved to a movable range end in the upward direction of the paper surface of FIG. 3, the overlapped areas between the first to third overlapping parts 12*b*, 13*b*, 12*c*, 13*c*, 12*d*, and 13*d* and the first to third intersecting parts 11*c*, 11*e*, and 11*g* are maximized (shown in FIG. 5C).

The phase shift circuit 1 shown in FIG. 2 and FIG. 3 has, for example, a cross-sectional structure as shown in FIG. 4. FIG. 4 shows a cross section of the phase shift circuit 1 taken along the x-x' section line shown in FIG. 3. The x-x' section line is crossing the part where the second intersecting part 11*e* of the signal line 11 and the second overlapping parts 12*c* and 13*c* of the first and second dielectric plates 12 and 13 are overlapped with each other. As shown in FIG. 4, in the overlapped portion, the second intersecting part 11*e* is interposed between the second overlapping parts 12*c* and 13*c*. Although illustration is omitted, the portion where the first intersecting part 11*c* and the first overlapping parts 12*b* and 13*b* are overlapped with each other and the portion where the third intersecting part 11*g* and the third overlapping parts 12*d* and 13*d* are overlapped with each other also have similar cross-sectional structures. More specifically, the first and third intersecting parts 11*c* and 11*g* are interposed between the first and third overlapping parts 12*b*, 13*b*, 12*d*, and 13*d*. However, as shown in FIG. 4, the second intersecting part 11*e* and the second overlapping parts 12*c* and 13*c* are not in contact with each other. The first intersecting part 11*c* and the first overlapping parts 12*b* and 13*b* are also not in contact with each other, and the third intersecting part 11*g* and the third overlapping parts 12*d* and 13*d* are also not in contact with each other.

In the structure of the phase shift circuit 1 described above, as a mechanism for moving the first and second dielectric plates 12 and 13 in the longitudinal direction of the phase shift circuit 1, for example, there is a mechanism described below, but this is not construed in a limiting sense. For example, in the mechanism shown in FIG. 2, the first supporting part 12*a* of the first dielectric plate 12 and the first supporting part 13*a* of the second dielectric plate 13 are coupled by a screw member 16 such as a screw rod. Similarly, the second supporting part 12*e* of the first dielectric plate 12 and the second supporting part 13*e* of the second dielectric plate 13 are coupled by a screw member 17 such as a screw rod. Furthermore, both end parts of the screw members 16 and 17 are caused to project from openings 14*a* and 15*a* provided in the first ground plate 14 and the second ground plate 15 so as to be movable along the openings 14*a* and 15*a*. Although not shown in the drawings, coupling members are coupled to projecting parts of the screw members 16 and 17 projecting from the openings 14*a* and 15*a*, screw members such as screw rods are mated with the coupling members, and the screw members are rotated by a motor or the like. By this means, the first and second dielectric plates 12 and 13 can be moved in the longitudinal direction of the phase shift circuit 1.

Also, in the structure of the phase shift circuit 1 described above, constituent elements are composed of materials described below, but these are not construed in a limiting sense. The signal line 11 is composed of a conductor and is made of, for example, a metal material such as copper. The first and second dielectric plates 12 and 13 are composed of dielectric bodies and are made of, for example, a resin material such as glass epoxy. The first and second ground plates 14 and 15 are composed of a conductor and are made of, for example, a metal material such as copper.

<Simulation Results of Phase Shift Circuit>

Figure 5B:
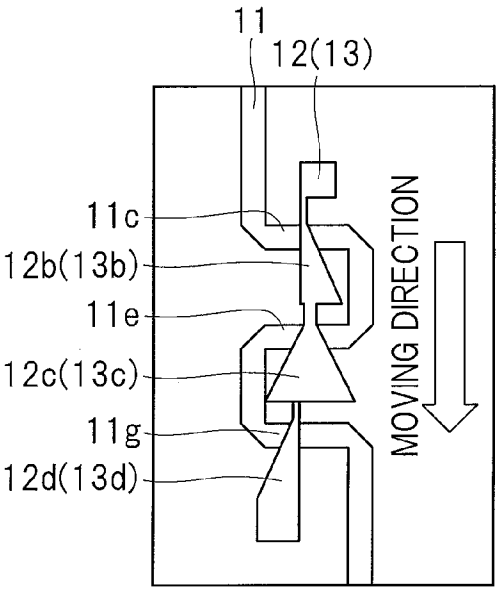
FIG. 5B is an explanatory drawing showing an example of the movement of the first and second dielectric plates in the simulation using the structure of the phase shift circuit of FIG. 2 to FIG. 4.
Figure 5C:
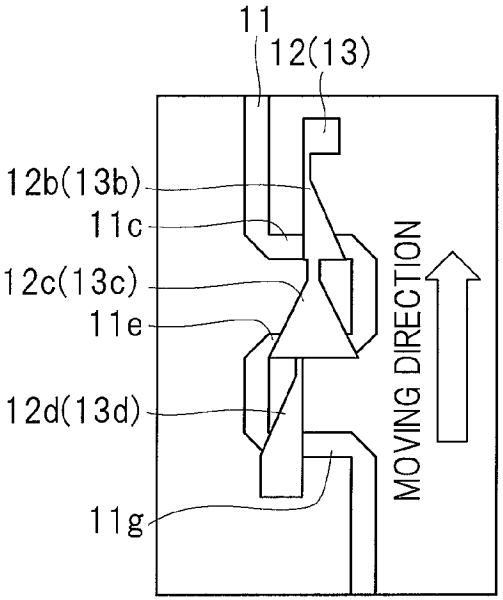
FIG. 5C is an explanatory drawing showing an example of the movement of the first and second dielectric plates in the simulation using the structure of the phase shift circuit of FIG. 2 to FIG. 4.
Figure 6:
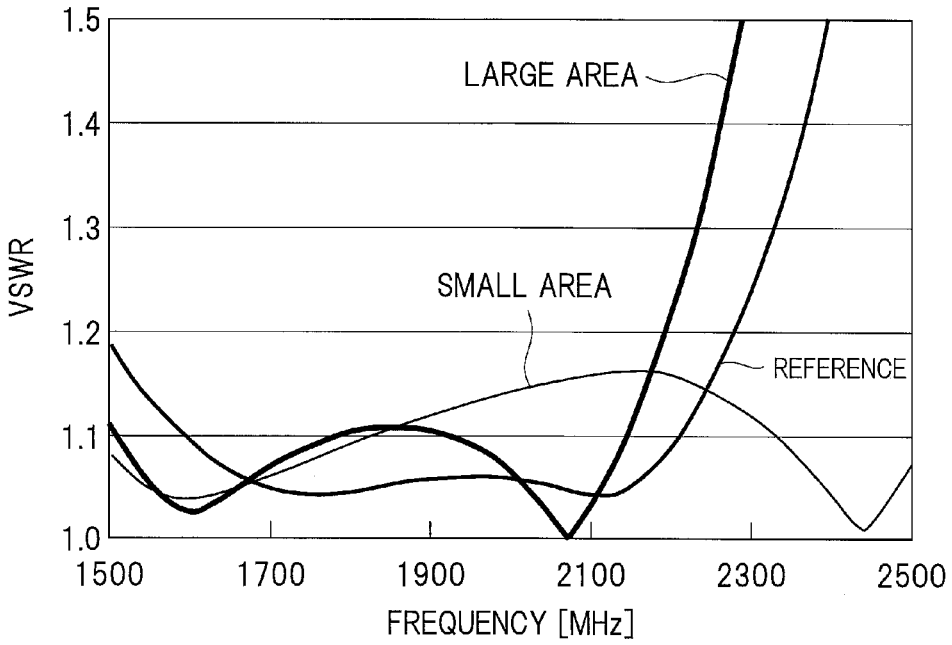
FIG. 6 is an explanatory drawing showing an example of the relation between frequency and VSWR in the result of the simulation shown in FIG. 5A to FIG. 5C.
Figure 7:
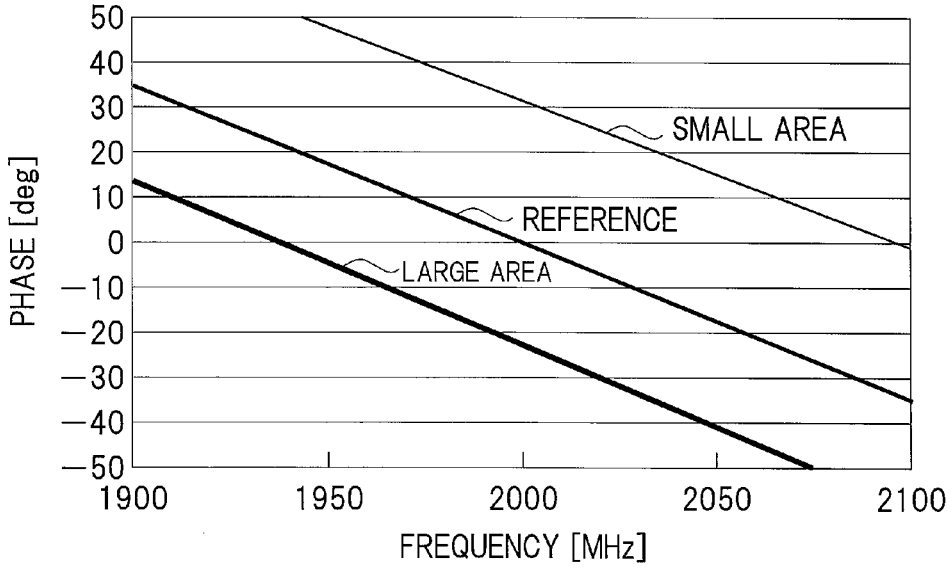
FIG. 7 is an explanatory drawing showing an example of the relation between frequency and phase in the result of the simulation shown in FIG. 5A to FIG. 5C.

Next, the simulation using the structure of the phase shift circuit 1 (1*a* to 1*f*) shown in FIG. 2 to FIG. 4 will be described with reference to FIGS. 5A-5C, 6 and 7. FIGS. 5A-5C are explanatory drawings showing an example of movement of the first and second dielectric plates 12 and 13 in the simulation using the structure of the phase shift circuit 1. FIG. 6 is an explanatory drawing showing an example of the relation between frequency and VSWR in the result of the simulation. FIG. 7 is an explanatory drawing showing an example of the relation between frequency and phase in the result of the simulation.

The simulation using the structure of the phase shift circuit 1 can be carried out by moving the first and second dielectric plates 12 and 13 in the longitudinal direction of the phase shift circuit 1 to change the areas (overlapped areas) in which the first to third overlapping parts 12*b*, 13*b*, 12*c*, 13*c*, 12*d*, and 13*d* of the first and second dielectric plates 12 and 13 and the first to third intersecting parts 11*c*, 11*e*, and 11*g* of the signal line 11 are overlapped with each other.

In the simulation, the case shown in FIG. 5A, the case shown in FIG. 5B, and the case shown in FIG. 5C were measured. FIG. 5A shows the case in which the position of the first and second dielectric plates 12 and 13 is at the intermediate position of the movable range of the first and second dielectric plates 12 and 13 (referred to as a reference here). FIG. 5B shows the case in which the first and second dielectric plates 12 and 13 are moved to the movable range end in the downward direction (moving direction) as denoted by the downward arrow of the paper surface of FIG. 5 and the overlapped area is the smallest (referred to as a small area here). FIG. 5C shows the case in which the first and second dielectric plates 12 and 13 are moved to the movable range end in the upward direction (moving direction) as denoted by the upward arrow of the paper surface of FIG. 5 and the overlapped area is the largest (referred to as a large area here). The downward direction of the paper surface of FIG. 5 mentioned here is the direction toward the signal output end 11*i* (e.g., FIG. 3) in the longitudinal direction of the phase shift circuit 1. The upward direction of the paper surface of FIG. 5, which is opposite thereto, is the direction toward the signal input end 11*a* (e.g., FIG. 3).

In the simulation, the signal line 11, the first and second dielectric plates 12 and 13, and the first and second ground plates 14 and 15 constituting the phase shift circuit 1 were formed under the following conditions. The distance between the first ground plate 14 and the second ground plate 15 was 5 mm. The thickness of the signal line 11 was 1 mm. The thickness of the first and second dielectric plates 12 and 13 was 2 mm. The width of the signal line 11 was 2.1 mm.

Regarding the areas in which the first and second dielectric plates 12 and 13 and the signal line 11 were overlapped with each other, the area in which the first overlapping parts 12*b* and 13*b* and the first intersecting part 11*c* were overlapped with each other is a first level, the area in which the second overlapping parts 12*c* and 13*c* and the second intersecting part 11*e* were overlapped with each other is a second level, the area in which the third overlapping parts 12*d* and 13*d* and the third intersecting part 11*g* were overlapped with each other is a third level, and the following conditions were employed. That is, in the case of the reference, the first level was 7.7 $mm^2$, the second level was 16.3 $mm^2$, and the third level was 7.7 $mm^2$, so that the area was 31.7 $mm^2$ in total. In the case of the small area, the first level was 2.4 $mm^2$, the second level was 3.7 $mm^2$, and the third level was 2.4 $mm^2$, so that the area was 8.5 $mm^2$ in total. In the case of the large area, the first level was 13.4 $mm^2$, the second level was 29.1 $mm^2$, and the third level was 13.4 $mm^2$, so that the area was 55.9 $mm^2$ in total.

Under the conditions of the simulation described above, the result as shown in FIG. 6 was acquired as the relation between the frequency and VSWR, and the result as shown in FIG. 7 was acquired as the relation between the frequency and phase.

In FIG. 6, the horizontal axis represents the frequency [MHz], and the vertical axis represents VSWR (Voltage Standing Wave Ratio). The simulation was carried out in a frequency range of 1500 MHz to 2500 MHz.

In the case of the reference, VSWR was 1.19 at a frequency of 1500 MHz, VSWR was reduced to 1.1 and 1.05 as the frequency was increased to 1600 MHz and 1700 MHz, and VSWR was reduced to 1.04 at a frequency of 1750 MHz. Then, VSWR was increased to 1.05 as the frequency was increased to 1900 MHz, and VSWR was increased to 1.06 at a frequency of 1950 MHz. Then, VSWR was reduced to 1.05 as the frequency was increased to 2100 MHz, and VSWR was reduced to 1.04 at a frequency of 2130 MHz. Then, VSWR was increased to 1.24 as the frequency was increased to 2300 MHz, and VSWR was increased as the frequency was further increased.

As described above, in the case of the reference, the relation between the frequency and VSWR had an approximately W-shaped characteristic, and VSWR was minimized to 1.04 at the frequencies of 1750 MHz and 2130 MHz. In the case of the reference, VSWR was 1.2 or less in the frequency band of 1500 MHz to 2250 MHz.

In the case of the small area, VSWR was 1.08 at a frequency of 1500 MHz, and VSWR was reduced to 1.04 at an increased frequency of 1600 MHz. Then, VSWR was increased to 1.06, 1.12, and 1.16 as the frequency was increased to 1700 MHz, 1900 MHz, and 2100 MHz, and VSWR was increased to 1.17 at a frequency of 2150 MHz. Then, VSWR was reduced to 1.12 as the frequency was increased to 2300 MHz, and VSWR was reduced to 1.0 at a frequency of 2438 MHz. Then, VSWR was increased to 1.08 when the frequency was increased to 2500 MHz.

As described above, in the case of the small area, the relation between the frequency and VSWR had an approximately W-shaped characteristic, VSWR was 1.0 at a frequency of 2438 MHz, and this 2438 MHz was a resonance frequency. Also, VSWR was 1.04 at a frequency of 1600 MHz. In the case of the small area, VSWR was 1.2 or less in the frequency band of 1500 MHz to 2500 MHz.

In the case of the large area, VSWR was 1.11 at a frequency of 1500 MHz, and VSWR was reduced to 1.03 at an increased frequency of 1600 MHz. Then, VSWR was increased to 1.06 as the frequency was increased to 1700 MHz, and VSWR was increased to 1.11 at a frequency of 1850 MHz. Then, VSWR was reduced to 1.1 as the frequency was increased to 1900 MHz, and VSWR was reduced to 1.0 at a frequency of 2070 MHz. Then, VSWR was increased to 1.03 and 1.24 as the frequency was increased to 2100 MHz and 2200 MHz, and VSWR was increased as the frequency was further increased.

As described above, in the case of the large area, the relation between the frequency and VSWR had an approximately W-shaped characteristic, VSWR was 1.0 at a frequency of 2070 MHz, and this 2070 MHz was a resonance frequency. Also, VSWR was 1.03 at a frequency of 1600 MHz. In the case of the large area, VSWR was 1.2 or less in the frequency band of 1500 MHz to 2100 MHz.

As described above, in the simulation result shown in FIG. 6, in the relation between the frequency and VSWR, in the frequency band of 1500 MHz to 2500 MHz, a resonance point at which VSWR was 1.0 was obtained at a frequency of 2438 MHz in the case of the small area, and a resonance point at which VSWR was 1.0 was obtained at a frequency of 2070 MHz in the case of the large area. As a result, it was discovered that the phase shift circuit 1 had the resonance points at the frequencies of 2438 MHz and 2070 MHz, respectively. Also, it was discovered that VSWR was 1.0 at the resonance points, and the phase shift circuit 1 was proved to be well matched also in terms of impedance matching.

At the resonance points, the influence of reflective waves to traveling waves of the signal input from the signal input end 11*a* and output from the signal output end 11*i* is minimized. For example, in FIG. 3, the position of the legs connecting the vertices D and the vertices F of the second overlapping parts 12*c* and 13*c* overlapping the second intersecting part 11*e* is a reflecting point of the reflective waves to the traveling waves, and the position of the hypotenuses connecting the vertices G and the vertices I of the third overlapping parts 12*d* and 13*d* overlapping the third intersecting part 11*g* is a reflecting point of the reflective waves to the traveling waves. The frequencies of the resonance points serve as the working frequencies of the phase shift circuit 1.

The simulation result as shown in FIG. 7 was acquired as the relation between the frequency and phase. In FIG. 7, the horizontal axis represents the frequency [MHz], and the vertical axis represents the phase [deg]. The simulation was carried out in a frequency range of 1900 MHz to 2100 MHz.

In the case of the reference, the relation between the frequency and phase was as follows. That is, the phase was +35 deg. at 1900 MHz, +17 deg. at 1950 MHz, 0 deg. at 2000 MHz, −18 deg. at 2050 MHz, and −34 deg. at 2100 MHz.

In the case of the small area, the relation between the frequency and phase was as follows. That is, the phase was +47 deg. at 1950 MHz, +32 deg. at 2000 MHz, +15 deg. at 2050 MHz, and 0 deg. at 2100 MHz.

In the case of the large area, the relation between the frequency and phase was as follows. That is, the phase was +13 deg. at 1900 MHz, −5 deg. at 1950 MHz, −23 deg. at 2000 MHz, and −41 deg. at 2050 MHz.

As described above, it was found out that, in any of the case of the reference, the case of the small area, and the case of the large area, in the relation between the frequency and phase, the phase was linearly changed from +phase to −phase, that is, from an advancing direction to a retarding direction as the frequency was increased in the frequency band of 1900 MHz to 2100 MHz.

Furthermore, in the relation between the frequency and phase, as shown in FIG. 7, when the phase in the case of the reference was 0 at a frequency of 2000 MHz, the phase in the case of the small area was +32 deg., and the phase in the case of the large area was −23 deg. The phase differences between the case of the reference, the case of the small area, and the case of the large area were constant also in the frequency range of 1900 MHz to 2100 MHz.

As described above, from the relation between the frequency and phase in the simulation result shown in FIG. 7, the phase shift circuit 1 was proved to have a characteristic of advancing the phase by 32 deg. in the case of the small area and retarding the phase by 23 deg. in the case of the large area with respect to the case of the reference.

<Effects of Embodiment>

According to the phase shift circuit 1 (1*a* to 1*f*) applied to the base-station antenna of the present embodiment described above, the phase shift circuit 1 has the signal line 11, the first dielectric plate 12, and the second dielectric plate 13. The signal line 11 has the first to third intersecting parts 11*c*, 11*e*, and 11*g* extending in the direction intersecting with the longitudinal direction of the phase shift circuit. On the other hand, the first dielectric plate 12 and the second dielectric plate 13 have the first to third overlapping parts 12*b*, 13*b*, 12*c*, 13*c*, 12*d*, and 13*d* overlapping the intersecting parts of the signal line 11. When the first dielectric plate 12 and the second dielectric plate 13 are moved in the longitudinal direction of the phase shift circuit, the overlapped areas between the intersecting parts 11*c*, 11*e*, and 11*g* of the signal line 11 and the overlapping parts 12*b*, 13*b*, 12*c*, 13*c*, 12*d*, and 13*d* of the first dielectric plate 12 and the second dielectric plate 13 are changed. By this means, instead of the structure in which the first and second dielectric plates 12 and 13 are inserted from the width direction of the phase shift circuit 1 like conventional cases, the structure in which the dielectric plates 12 and 13 are moved in the longitudinal direction of the phase shift circuit 1 can be employed. Therefore, the width-direction size of the phase shift circuit 1 can be reduced as much as possible. Consequently, the width-direction size of the base-station antenna can be also reduced. As a result, a reduction in the size of the base-station antenna can be achieved. The reduction in the size of the base-station antenna can contribute to reduction in the cost of the base-station antenna.

Also, since the first and second dielectric plates 12 and 13 are configured to be moved in the longitudinal direction of the phase shift circuit 1, the moving mechanism of the first and second dielectric plates 12 and 13 can be simplified compared with the conventional configuration in which they are moved in the width direction of the phase shift circuit 1. More specifically, since the first and second dielectric plates 12 and 13 can be moved along the openings 14*a* and 15*a* provided in the first and second ground plates 14 and 15 by causing the both end parts of the screw members 16 and 17 coupled to the first and second dielectric plates 12 and 13 to project from the openings 14*a* and 15*a*, the moving mechanism of the first and second dielectric plates 12 and 13 can be formed with a simple configuration.

Moreover, the overlapped areas between the first to third overlapping parts 12*b*, 13*b*, 12*c*, 13*c*, 12*d*, and 13*d* of the first and second dielectric plates 12 and 13 and the first to third intersecting parts 11*c*, 11*e*, and 11*g* of the signal line 11 are changed by moving the first and second dielectric plates 12 and 13 in the longitudinal direction of the phase shift circuit 1. Therefore, the phase shift circuit 1 capable of setting a desired resonance frequency in the relation between the frequency and VSWR can be realized, and the phase shift circuit 1 capable of setting a desired phase difference in the relation between the frequency and phase can be realized.

Furthermore, according to the present embodiment, the following effects can be obtained.

(1) The first and second dielectric plates 12 and 13 are composed by the combinations of the first overlapping parts 12*b* and 13*b* having the right triangular shapes, the second overlapping parts 12*c* and 13*c* having the isosceles triangular shapes, and the third overlapping parts 12*d* and 13*d* having the right triangular shapes.

Therefore, the overlapped area with the first to third intersecting parts 11*c*, 11*e*, and 11*g* of the signal line 11 can be set in a wide range from the small area to the large area.

(2) The hypotenuses of the first overlapping parts 12*b* and 13*b*, the legs of the second overlapping parts 12*c* and 13*c*, and the hypotenuses of the third overlapping parts 12*d* and 13*d* are designed to form angles equal to or less than a right angle with respect to the extending direction of the first to third intersecting parts 11*c*, 11*e*, and 11*g*. Therefore, two resonance frequencies can be set while using the positions of the legs of the second overlapping parts 12*c* and 13*c* and the positions of the hypotenuses of the third overlapping parts 12*d* and 13*d* as reflecting points of reflective waves with respect to traveling waves.

<Modification Examples of Embodiment>

The following modification examples are conceivable for the phase shift circuits 1 (1*a* to 1*f*) applied to the base-station antenna according to the above-described present embodiment.

(1) FIG. 2 shows the example in which the first intersecting part 11*c* and the second intersecting part 11*e* are connected through the second connecting part 11*d* in a U-shape and the second intersecting part 11*e* and the third intersecting part 11*g* are connected through the third connecting part 11*f* in a U-shape, so that the two U-shaped parts are present (two resonance points of frequencies are present). However, any number of the U-shaped parts may be provided. For example, the invention can be applied also to the case in which the number of the U-shaped parts is one, three, or more. If the number of the U-shaped parts is one, one resonance point of frequencies is present. Also in such a configuration, effects of reducing the width-direction size of the phase shift circuit as much as possible and others can be obtained like the above-described embodiment.

(2) FIG. 2 shows the example in which the first overlapping parts 12*b* and 13*b* have the right triangular shapes, the second overlapping parts 12*c* and 13*c* have the isosceles triangular shapes, and the third overlapping parts 12*d* and 13*d* have right triangular shapes. However, the overlapping parts may have any shapes as long as overlapped areas are changed when the first and second dielectric plates 12 and 13 are moved. Particularly, it is desired that the areas be linearly changed. For example, the invention can be also applied to all triangles other than right triangles and isosceles triangles and to other shapes. Also in such a configuration, effects of reducing the width-direction size of the phase shift circuit as much as possible and others can be obtained like the above-described embodiment.

Figure 8:
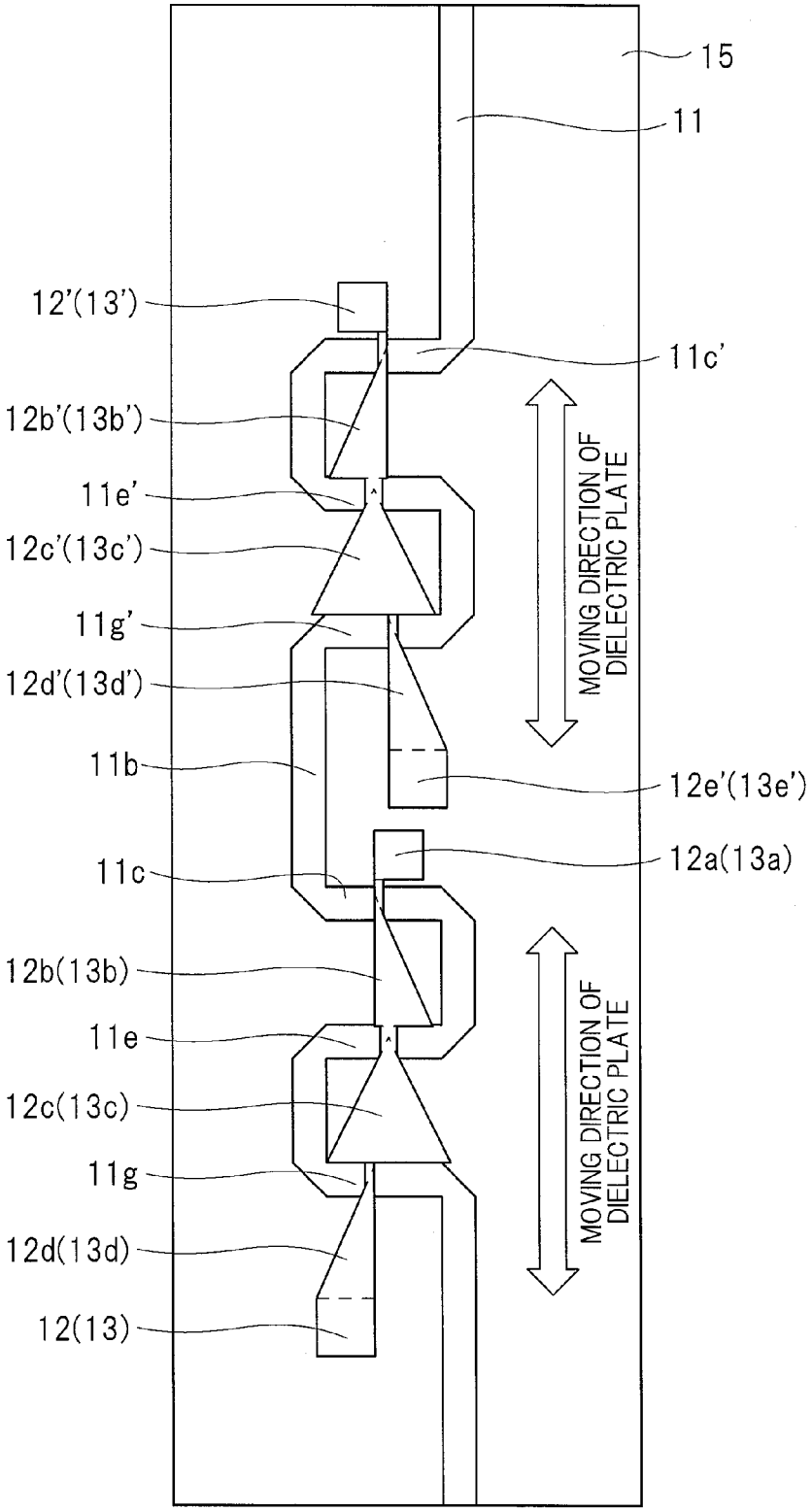
FIG. 8 is a plan view showing a modification example of the structure of the phase shift circuit applied to the base-station antenna of FIG. 1.

(3) FIG. 2 shows the configuration in which the first and second dielectric plates 12 and 13 and the first to third intersecting parts 11*c*, 11*e*, and 11*g* are overlapped with each other. Alternatively, for example, one set of the first and second dielectric plates 12 and 13 and the first to third intersecting parts 11*c*, 11*e*, and 11*g* and another set of those having the same shapes may be disposed in series as shown in FIG. 8. FIG. 8 is a plan view showing a modification example of the structure of the phase shift circuit. Although FIG. 8 shows the example in which two sets of the configuration are disposed in series, it goes without saying that the invention can be applied also to the example in which three or more sets thereof are disposed.

FIG. 8 shows the configuration in which the first and second dielectric plates 12' and 13' disposed on the upper side of the paper surface of FIG. 8 and the first and second dielectric plates 12 and 13 disposed on the lower side of the paper surface of FIG. 8 are directed to opposite sides in the left/right direction because of a meander shape of the signal line 11. The first and second dielectric plates 12 and 13 disposed on the lower side have the same structure as FIG. 2 and others of the above-described embodiment. The configuration applied to such a case is as follows.

In the configuration of FIG. 8, when the first and second dielectric plates 12 and 13 are moved on the front surface and back surface of the signal line 11 as denoted by the corresponding arrow, the first and second dielectric plates 12' and 13' are moved in the same movable range in the same direction of the longitudinal direction of the phase shift circuit as denoted by the corresponding arrow. The configuration and effects of the embodiment are the same as those of the embodiment described above in FIG. 2 and others. The line length of the first connecting part 11*b* connecting a third intersecting part 11*g'* and the first intersecting part 11*c* to each other needs to be equal to or longer than a length capable of forming second supporting parts 12*e'* and 13*e'* of the first and second dielectric plates 12' and 13' and the first supporting parts 12*a* and 13*a* of the first and second dielectric plates 12 and 13.

More specifically, in the configuration shown in FIG. 8, the signal line 11 has a plurality of conductor forming parts, which are mutually coupled. The plurality of conductor forming parts have first intersecting parts 11*c* and 11*c'*, second intersecting parts 11*e* and 11*e'*, and third intersecting parts 11*g* and 11*g'*. Also, the first and second dielectric plates 12, 12', 13, and 13' have a plurality of dielectric forming parts, which are movable in synchronization with each other. The plurality of dielectric forming parts have first overlapping parts 12*b*, 12*b'*, 13*b*, and 13*b'*, second overlapping parts 12*c*, 12*c'*, 13*c*, and 13*c'*, and third overlapping parts 12*d*, 12*d'*, 13*d*, and 13*d'*.

More specific configurations and shapes such as U-shapes, triangles, right triangles, and isosceles triangles are the same as those of the above-described embodiment, the modification examples of (1) and (2) described above and others.

Also in such a configuration, effects of reducing the width-direction size of the phase shift circuit as much as possible and others can be obtained like the above-described embodiment.

In the foregoing, the invention made by the inventors of the present invention has been concretely described based on the embodiment. However, it is needless to say that the present invention is not limited to the foregoing embodiment and various modifications and alterations can be made within the scope of the present invention.

What is claimed is:

1. A phase shift circuit for changing a phase of a signal comprising:

a first dielectric body and a second dielectric body opposed to each other; and a first conductor disposed between the first dielectric body and the second dielectric body, wherein the first conductor is provided with an intersecting part extending in a direction intersecting with a longitudinal direction of the phase shift circuit, each of the first dielectric body and the second dielectric body is provided with an overlapping part overlapping the intersecting part of the first conductor, and an overlapped area between the intersecting part and the overlapping part is changed as the first dielectric body and the second dielectric body are moved in the longitudinal direction of the phase shift circuit, wherein the first conductor has a signal input end on one longitudinal end side, a signal output end on another longitudinal end side located opposite to the one longitudinal end side, and a line connecting the signal input end and the signal output end, wherein the line includes the intersecting part which is a linear line extending in a direction perpendicular to a longitudinal direction of the phase shift circuit; and a plurality of connecting parts which are linear lines connected to the intersecting part extending in a direction parallel to the longitudinal direction of the phase shift circuit; and wherein the plurality of connecting parts includes a first connecting part which is connected to the signal input end and extends from the signal input end to the intersecting part; and a second connecting part which is connected to the signal output end and extends from the signal output end to the intersecting part.

2. The phase shift circuit according to claim 1, wherein the first conductor is provided with a plurality of said intersecting parts, including the intersecting part, each of the first dielectric body and the second dielectric body is provided with a plurality of said overlapping parts, including the overlapping part, and corresponding to the plurality of intersecting parts, and a plurality of overlapped areas including the overlapped area is disposed between the respective plurality of intersecting parts and the corresponding plurality of overlapping parts, and the plurality of overlapped areas are changed as the first dielectric body and the second dielectric body are moved in the longitudinal direction of the phase shift circuit.

3. The phase shift circuit according to claim 1, wherein the first dielectric body is disposed to be opposed to a first principal surface of the first conductor, and the second dielectric body is disposed to be opposed to a second principal surface of the first conductor on an opposite side of the first principal surface.

4. The phase shift circuit according to claim 2, wherein the first conductor has, as the plurality of intersecting parts, first to third intersecting parts mutually coupled via the connecting parts extending in the longitudinal direction of the phase shift circuit, and each of the first dielectric body and the second dielectric body has, as the plurality of overlapping parts, first to third overlapping parts respectively overlapping the first to third intersecting parts.

5. The phase shift circuit according to claim 4, wherein one end of the first intersecting part is connected to an input end of the signal via the first connecting part, one end of the second intersecting part is connected to the other end of the first intersecting part via a third connecting part, one end of the third intersecting part is connected to the other end of the second intersecting part via a fourth connecting part, the other end of the third intersecting part is connected to an output end of the signal via the second connecting part, one end of the first overlapping part is connected to a first supporting part, one end of the second overlapping part is connected to the other end of the first overlapping part, one end of the third overlapping part is connected to the other end of the second overlapping part, the other end of the third overlapping part is connected to a second supporting part, and the first supporting part and the second supporting part are coupled to each other between the first dielectric body and the second dielectric body.

6. The phase shift circuit according to claim 5, wherein the first to third overlapping parts respectively have shapes with which the overlapped areas with the first to third intersecting parts are changed as the first dielectric body and the second dielectric body are moved in the longitudinal direction of the phase shift circuit, and the shapes include a triangular shape.

7. The phase shift circuit according to claim 6, wherein the first overlapping part has a shape of a right triangle, the second overlapping part has a shape of an isosceles triangle, the third overlapping part has a shape of a right triangle, a hypotenuse of the right triangle of the first overlapping part forms a first angle, which is equal to or less than a right angle, with an extending direction of the first intersecting part, a first leg and a second leg of the isosceles triangle of the second overlapping part respectively form a second angle and a third angle, which are equal to or less than a right angle, with an extending direction of the second intersecting part, and a hypotenuse of the right triangle of the third overlapping part forms a fourth angle, which is equal to or less than a right angle, with an extending direction of the third intersecting part.

8. The phase shift circuit according to claim 2, wherein the first conductor has a plurality of conductor forming parts that are mutually coupled to each other, the plurality of conductor forming parts have the plurality of intersecting parts, respectively, each of the first dielectric body and the second dielectric body has a plurality of dielectric forming parts which are movable in synchronization with each other, and the plurality of dielectric forming parts have the plurality of overlapping parts, respectively.

9. The phase shift circuit according to claim 1, further comprising:

a second conductor and a third conductor of ground plates respectively disposed to be opposed to surfaces of the first dielectric body and the second dielectric body, the surfaces being on opposite sides of the first conductor.

10. An antenna device comprising:

a phase shift circuit for changing a phase of a signal, the phase shift circuit including:

a first dielectric body and a second dielectric body opposed to each other; and a first conductor disposed between the first dielectric body and the second dielectric body, wherein the first conductor is provided with an intersecting part extending in a direction intersecting with a longitudinal direction of the phase shift circuit, each of the first dielectric body and the second dielectric body is provided with an overlapping part overlapping the intersecting part of the first conductor, and an overlapped area between the intersecting part and the overlapping part is changed as the first dielectric body and the second dielectric body are moved in the longitudinal direction of the phase shift circuit, wherein the first conductor has a signal input end on one longitudinal end side, a signal output end on another longitudinal end side located opposite to the one longitudinal end side, and a line connecting the signal input end and the signal output end, and the intersecting part is provided on the line.

* * * * *